US006082336A

United States Patent [19]

Takahashi et al.

[11] Patent Number: 6,082,336

[45] Date of Patent: Jul. 4, 2000

[54] FUEL PUMP ARRANGEMENT FOR ENGINE

[75] Inventors: Masanori Takahashi; Hitoshi Watanabe, both of Hamamatsu, Japan

[73] Assignee: Sanshin Kogyo Kabushiki Kaisha, Hamamatsu, Japan

[21] Appl. No.: 08/819,298

[22] Filed: Mar. 18, 1997

[30] Foreign Application Priority Data

Mar. 18, 1996 [JP] Japan ..... 8-088762

[51] Int. Cl.[7] ..... F02M 37/04

[52] U.S. Cl. ..... 123/508; 123/509

[58] Field of Search ..... 123/508, 509, 123/495, 516, 514

[56] References Cited

U.S. PATENT DOCUMENTS

| | | | |
|---|---|---|---|
| 2,955,582 | 11/1960 | Taylor | 123/508 |
| 4,391,258 | 7/1983 | Claesson | 123/508 |
| 4,412,513 | 11/1983 | Obermayer | 123/508 |
| 4,538,561 | 9/1985 | Amenori | 123/508 |
| 5,036,822 | 8/1991 | Kojima | 123/509 |
| 5,201,300 | 4/1993 | Iiyama | 123/508 |
| 5,309,885 | 5/1994 | Rawlings | 123/509 |
| 5,323,750 | 6/1994 | Rotter | 123/508 |
| 5,390,642 | 2/1995 | Thoma | 123/508 |
| 5,501,197 | 3/1996 | Smith | 123/509 |
| 5,603,303 | 2/1997 | Okajima | 123/508 |

FOREIGN PATENT DOCUMENTS

| | | | |
|---|---|---|---|
| 8101593 | 6/1981 | European Pat. Off. | 123/508 |
| 0042814 | 10/1937 | Netherlands | 123/508 |

*Primary Examiner*—Carl S. Miller

*Attorney, Agent, or Firm*—Knobbe, Martens, Olson & Bear LLP

[57] ABSTRACT

Several embodiments of outboard motors having four cycle internal combustion engines wherein one or more fuel pumps are directly driven by the lobes of the camshafts that operate the valves of the engine. This provides a very compact assembly, permits latitude in the location of the fuel pump or pumps and also minimizes the number of driving connections that are required.

18 Claims, 9 Drawing Sheets

FUEL PUMP ARRANGEMENT FOR ENGINE

BACKGROUND OF THE INVENTION

This invention relates to a fuel pump arrangement for an engine and particularly to an improved fuel pump drive arrangement that can be utilized with a four-cycle outboard motor.

The charge forming systems for internal combustion engines normally employ a one or more fuel pumps for pumping fuel to the charge formers of the engine. This is true regardless of whether the charge former is a carburetor or a fuel injector. Although a wide variety of types of fuel pumps and fuel pump drivers are employed. One conventional type of system used with four cycle engines employs a fuel pump that is driven from the camshaft of the engine. Normally, the fuel pump is driven off of an end of the camshaft through a drive coupling. This type of arrangement has a number of disadvantageous.

First, the utilization of the drive coupling provides a mechanical connection which can complicate other servicing of the engine. For example, if the drive coupling is positioned adjacent the camshaft drive mechanism, then the setting of the timing of the camshaft may become difficult.

In addition to the basic drive problems, the location of the drive for the fuel pump off of an end of the camshaft generally dictates that the fuel pump is disposed at one end or the other of the engine. This does not permit the optimization of the location of the fuel pump to the components to which it supplies fuel. That is, if there is provided a fuel injector or carburetor for each cylinder, then the fuel pump may positioned at a substantially greater distance from one charge former than the others.

Finally, this end positioning of the fuel pump tends to add to the overall length of the engine. This is particularly disadvantageous when the engine is employed in conjunction with an outboard motor. As is well known, outboard motors have very compact construction and there is not a lot of space available between the external periphery of the engine of the outboard motor and its surrounding protective cowling.

It is, therefore, a principal object of this invention to provide an improved and compact fuel pump and drive arrangement for an internal combustion engine.

It is a further object of this invention to provide an improved and compact drive for the fuel pump of an outboard motor.

It is a still further object of this invention to provide an improved and compact drive arrangement for driving a fuel pump of an engine from the engine camshaft.

It is a still further object of this invention to provide an improved fuel pump drive arrangement for an internal combustion engine wherein a greater latitude is possible in the positioning of the fuel pump due to the manner in which it is driven.

SUMMARY OF THE INVENTION

This invention relates to an internal combustion engine having a cylinder block and cylinder head that define at least one cylinder bore in which a piston reciprocates to form a combustion chamber. The piston drives an engine output shaft an intake and an exhaust valve are provided for valving intake and exhaust passages that permit flow into and out of the combustion chamber. At least one camshaft is rotatably journaled by the engine and is driven by its output shaft in timed relationship for operating at least one of the valves.

The camshaft has at least one cam that is associated with the at least one valve for operating that one valve. A fuel pump is mounted on the engine and has a driving element that is positioned in proximity to the cam for driving the fuel pump directly from a cam that operates a valve of the engine.

DETAILED DESCRIPTION OF THE PREFERRED EMBODIMENTS OF THE INVENTION

Figure 1:
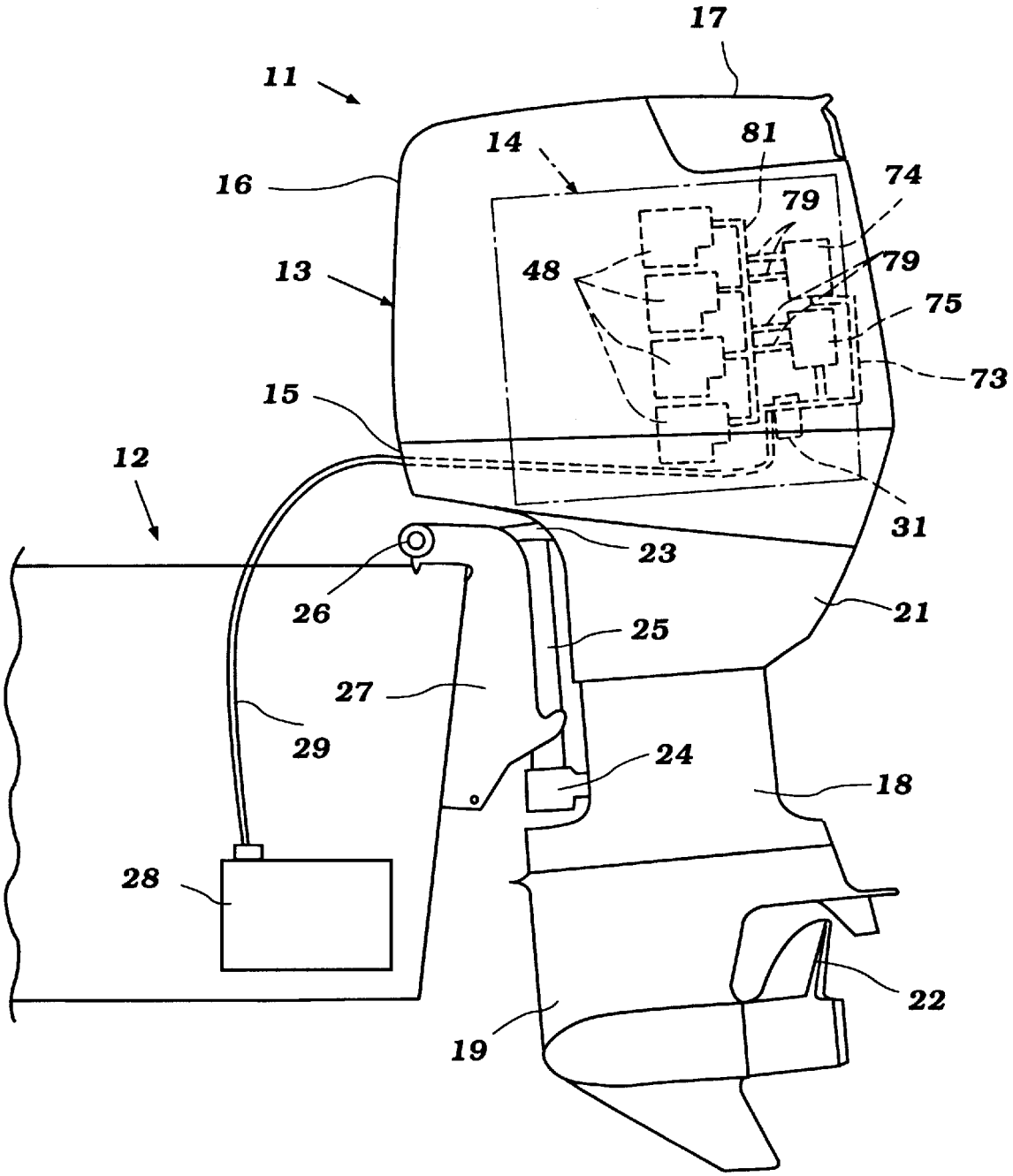
FIG. 1 is a side elevational view of an outboard motor attached to a watercraft that is shown partially and which outboard motor embodies the invention.

Referring now in detail to the drawings and first to the embodiment of FIGS. 1–5 but initially to FIG. 1, an outboard motor constructed in accordance with an embodiment of the invention is shown generally by the reference numeral 11 and is depicted as being attached to the transom of a watercraft, shown partially and indicated generally by the reference numeral 12. The invention is described in conjunction with an outboard motor because the invention has particular utility in the drive of fuel pumps for internal combustion engines such as are utilized in outboard motors.

The invention has particular utility in conjunction with outboard motors because of the compact drive arrangement provided for driving the fuel pumps of the various embodiments which will be described. Although such an environment is illustrated and described, it will be readily apparent to those skilled in the art how the invention can be practiced with other applications for internal combustion engines.

The outboard motor 11 is comprised of a powerhead, indicated generally by the reference numeral 13, which is comprised in primary part of an internal combustion engine, indicated generally the reference numeral 14. In the illustrated embodiment, the engine 14 is of a four-cylinder inline type operating on a four-cycle principal. The details of the engine 14 and specifically the fuel supply system therefore will be described later by principal reference to the remaining figures of this embodiment.

The powerhead 13 is completed by a protective cowling that is comprised of a lower tray portion 15 and an upper main cowling portion 16. The tray portion 15 is formed from a lightweight relatively strong material such as aluminum or an aluminum alloy. The main cowling portion 16 is formed from a lighter weight and somewhat weaker material such as a molded fiberglass reinforce resin or the like. The main cowling portion 16 also includes a rear cover piece 17 that defines both a hand grip for pulling up of the outboard motor 11 and also an air inlet for delivering air to the interior of the protective cowling for combustion in the engine 14.

A driveshaft housing and lower unit assembly comprised of a driveshaft housing 18 and lower unit 19 depend from the powerhead 13. A shroud 21 encircles a portion of the tray 15 and the upper portion of the driveshaft housing 18 so as to provide a neat appearance and to protect the internal components.

A driveshaft (not shown) is driven by the crankshaft of the engine 14 for propelling the associated watercraft. This driveshaft is journaled in the driveshaft housing 18 and lower unit 19 in a known manner. To facilitate the drive of the driveshaft, the engine 14 is supported in the powerhead 13 so its crankshaft (illustrated in later figures) rotates about a vertically extending axis. This will also be described by reference to the later figures of this embodiment.

The driveshaft drives a forward neutral reverse transmission (not shown) that is contained in the lower unit 19 for driving a propeller 22 in selected forward or reverse directions.

A steering shaft (not shown) is affixed to the driveshaft housing 18 by upper and lower brackets 23 and 24. This steering shaft is journaled for rotation within a swivel bracket 25 for steering of the outboard motor 11 about a generally vertically extending steering axis in a manner well known in this art.

The swivel bracket 25 is, in turn, pivotally connected by a pivot pin 26 to a clamping bracket 27. The clamping bracket 27 is suitably affixed to the transom of the hull of the watercraft 12. Pivotal movement of the swivel bracket 25 relative to the clamping bracket 27 about the pivot pin 26 accommodates tilt and trim movement of the outboard motor 11 as is also well known in this art.

Fuel is supplied to the engine 14 for combustion therein from a remotely positioned fuel tank 28 that is mounted in the hull of the watercraft 12. A conduit 29 connects the fuel tank 28 to the engine fuel supply system and particularly to a fuel filter 31 therefor. The conduit 29 maybe provided with a priming pump (not shown) and a quick disconnect coupling in the vicinity of the tray 15.

The construction of the outboard motor 11 as thus far described may be considered to be conventional. For that reason, those components which form no part of the invention have been described only summarily if at all. Where any components of the outboard motor 11 have not been illustrated or are not described, reference may be had to any known construction in the prior art for suitable components which can be utilized to practice the invention.

The fuel supply system for the engine will now be described by primary reference to FIGS. 2–5 as will additional components of the engine 14.

As has been noted, in the illustrated embodiment, the engine 14 is of the four cylinder in-line type. To this end, the engine 14 is provided with a cylinder block, indicated generally by the reference numeral 32, that forms four horizontally extending cylinder bores 33, the axes of which extend one above the other. Although the invention is described in conjunction with a four cylinder in-line type, it will be readily apparent to those skilled in the art how the invention can be utilized with engines having a wide variety of numbers of cylinders. In addition, the invention can also be employed in conjunction with engines having angularly related cylinder banks such as V type, opposed or the like engines.

Pistons 34 reciprocate in the cylinder bores 33. These pistons 34 are connected by means of piston pins 35 to connecting rods 36. The connecting rods 36 are, in turn, journaled on the throws 37 of a crankshaft 38. This crankshaft 38 rotates about a generally vertically extending axis for the reasons aforenoted. The crankshaft 38 is journaled within a crankcase chamber 39 that is formed by the skirt of the cylinder block 32 and a crankcase member 41 that is detachably affixed thereto.

A cylinder head, indicated generally by the reference numeral 42, is affixed to the cylinder block 32 in any well-known manner. This cylinder head 42 is shown in cross-section in FIG. 5. The cylinder head 42 is provided with a plurality of individual recesses 43 each of which cooperates with the cylinder bores 33 and the heads of the pistons 34 to form the combustion chambers of the engine.

Figure 2:
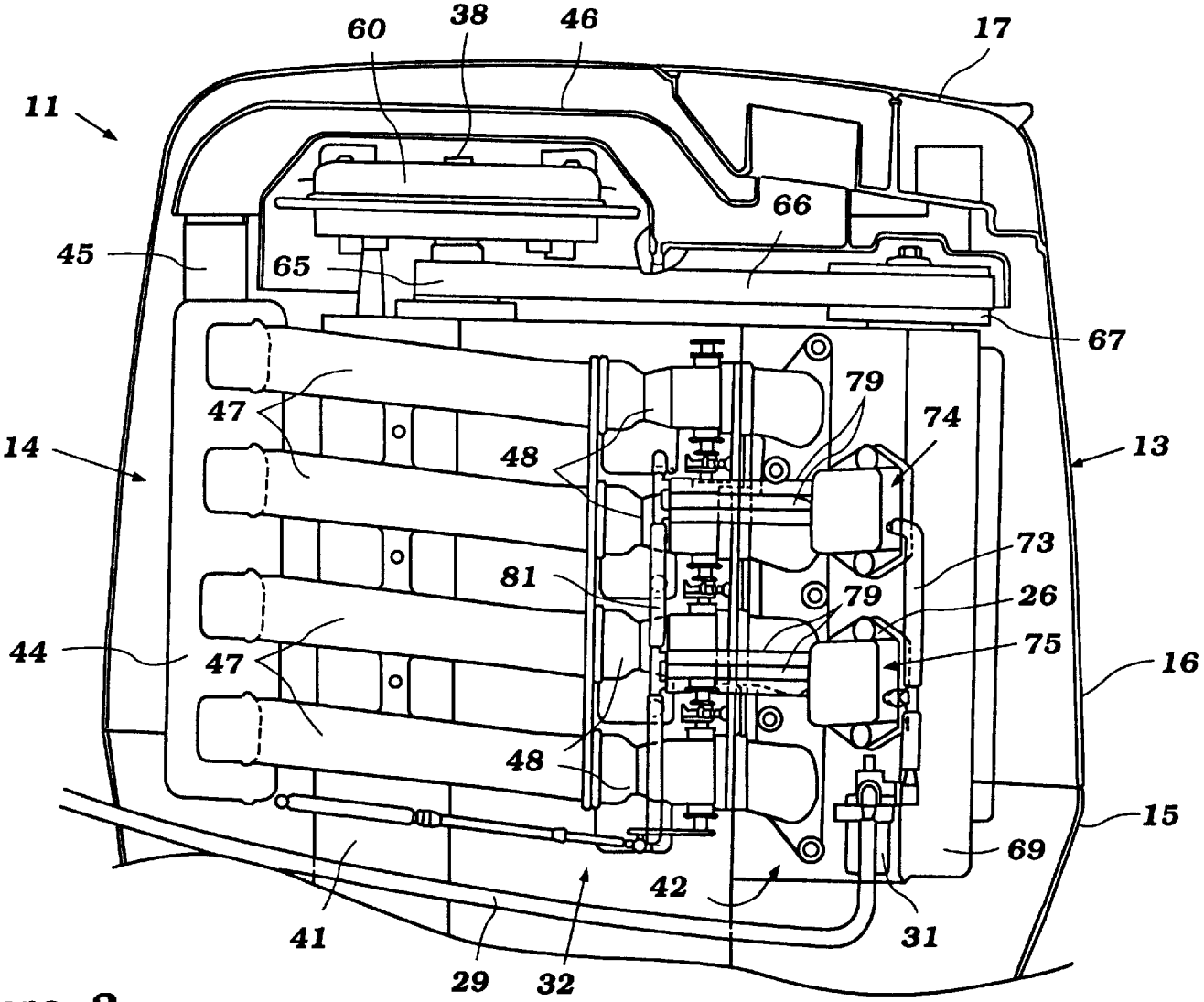
FIG. 2 is an enlarged side elevational view of the powerhead of the outboard motor looking in the same direction as FIG. 1 but with the protective cowling broken away so as to more clearly show the fuel pump and driving arrangement.
Figure 3:
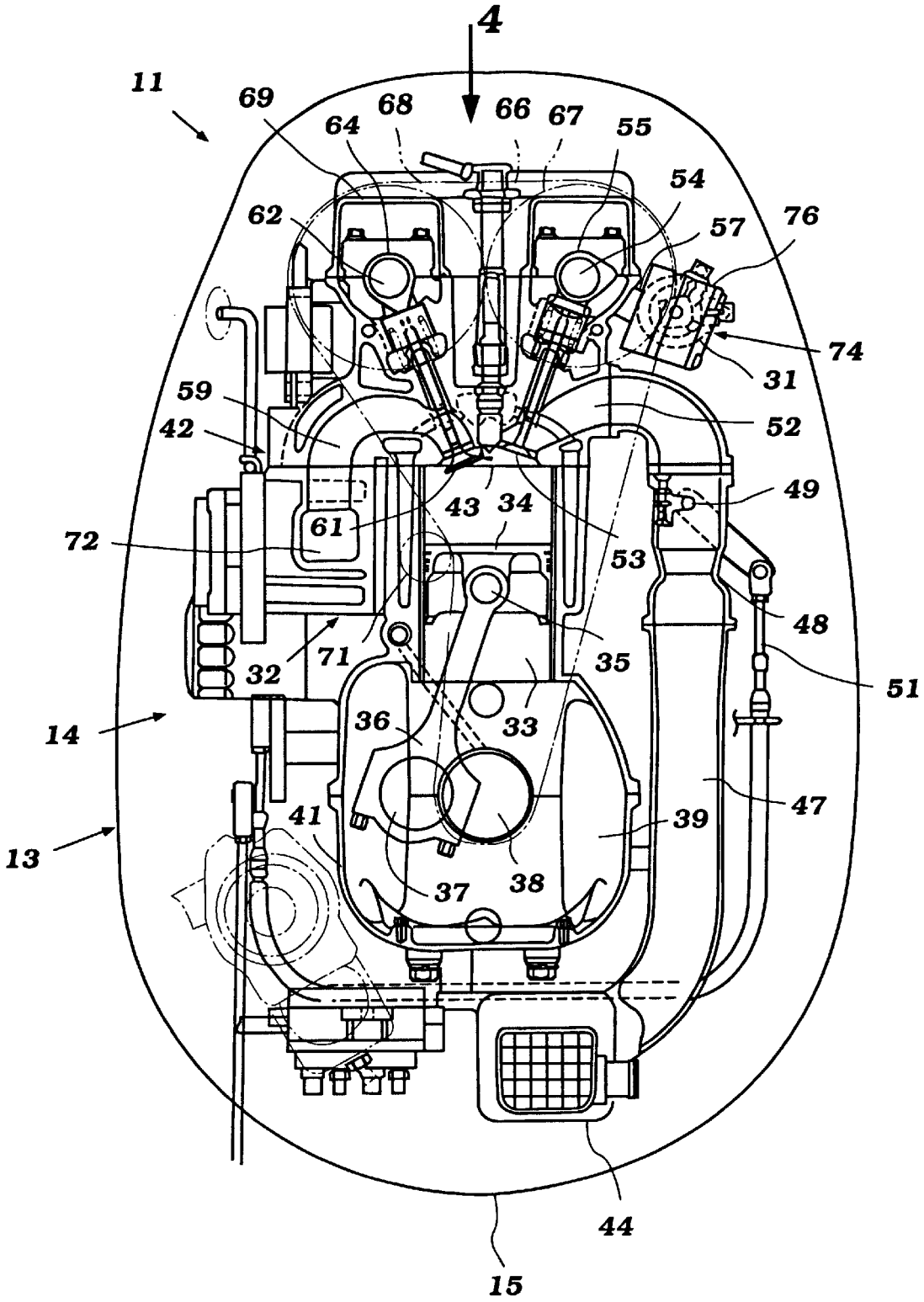
FIG. 3 is a top plan view of the powerhead of the outboard motor with the main cowling portion of the protective cowling removed and certain portions broken away and shown in section.
Figure 5:
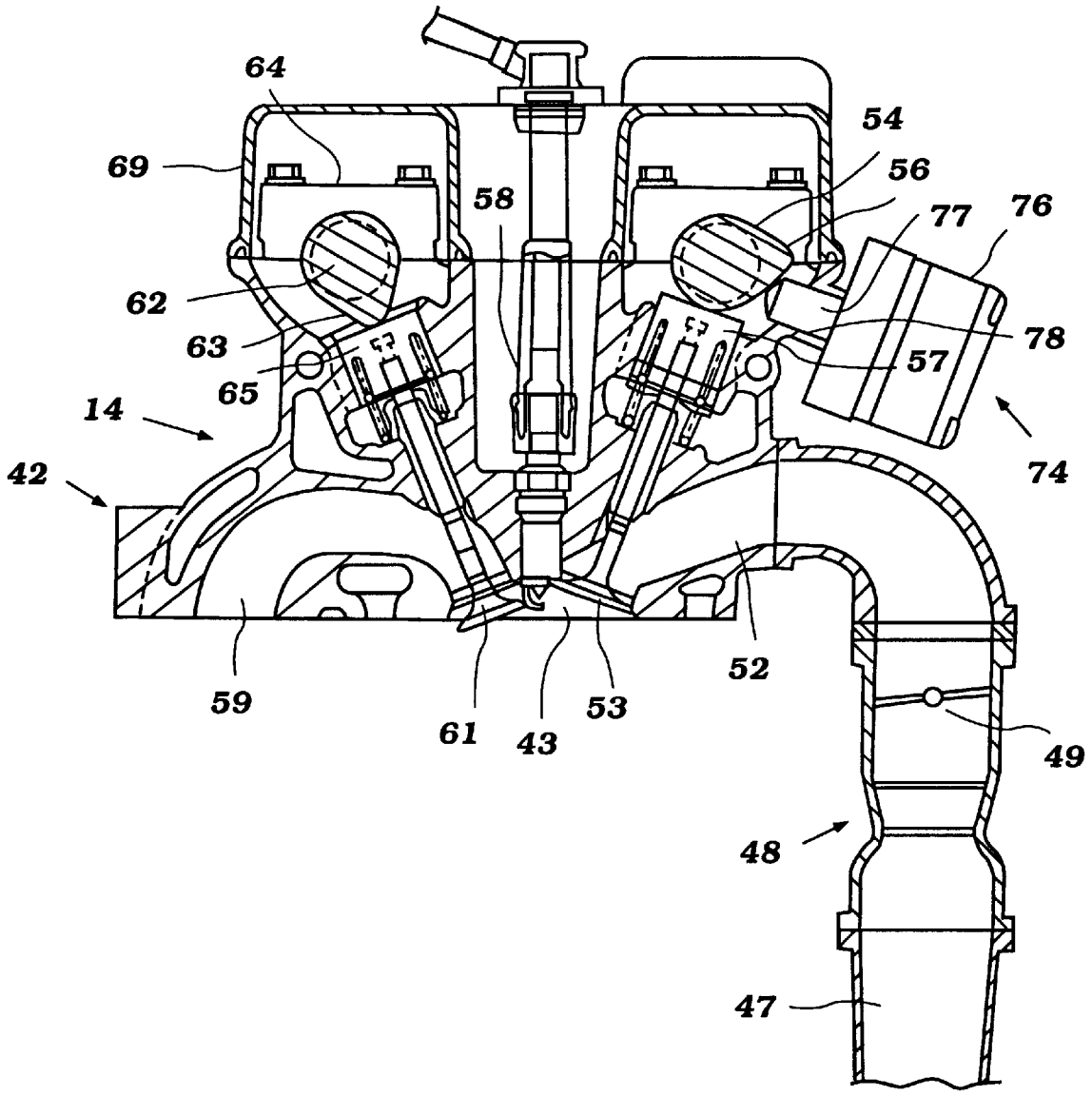
FIG. 5 is a cross-sectional view taken generally along the line 5—5 of FIG. 4 but showing only the cylinder head construction.

An air charge is delivered to the combustion chambers through an induction system that is disposed at one side of the engine and which appears in most detail in FIGS. 2, 3 and 5. This induction system includes an air inlet device 44 that is positioned at the forward end of the engine and which has an air inlet pipe 45 that receives air from the atmosphere through an inlet conduit 46 which forms in part a cover over the upper portion of the engine.

An intake manifold comprised of a plurality of manifold runners 47 receives air from the inlet device 44, which inlet device also functions as a plenum chamber, and delivers it to individual charge formers such as carburetors 48. Although the invention is described in conjunction with a carbureted engine, it will be readily apparent to those skilled in the art that the invention can also be utilized with fuel injected engines. For this reason, details of the carburetors 48 are not shown.

However, the carburetors 48 each have throttle valves 49 that are mounted on throttle valve shafts and which are controlled by a suitable throttle linkage system 51 in a manner well known in this art.

Fuel is supplied to the carburetors 48 in a manner which will be described and which incorporates an important feature of the invention.

The carburetors 48 serve individual intake passages 52 that are formed in the cylinder head 42 at the intake manifold side thereof. These intake passages 52 extend to intake valve seats which are valved by intake valves 53 that are supported for reciprocation within the cylinder head 42 in a well known manner. These intake valves 53 are urged toward their closed positions by suitable coil compression springs that act against keeper retainer assemblies.

An intake camshaft 54 is journaled for rotation in the cylinder head 42 by means that include bearing caps 55. The intake camshaft 54 has individual cam lobes 56 that cooperate with thimble tappet assemblies 57 for opening the intake valves 53 in a manner well known in this art.

The intake charge comprised of fuel and air which are delivered to the combustion chamber recesses 43 through the induction system thus far described is fired by means of spark plugs 58 that are mounted in the cylinder head 42. The spark plugs 58 have their spark gaps extending into the cylinder head recesses 43. The spark plugs 58 are fired by any suitable ignition system which may include a magneto generator 60 driven off of the upper end of the crankshaft 38.

The charge which is admitted to the combustion chambers and ignited therein by the spark plugs 58 will burn and expand to operate the pistons 33 and provide output power through the crankshaft 38 in a manner that is well known in this art.

Exhaust passages 59 are formed in the cylinder head 42 on the side opposite the intake passages 52. These exhaust passages 59 are valved by tappet type exhaust valves 61 which are also slidably supported in the cylinder head assembly 42 in a known manner. As with the intake valves 53, the exhaust valve 61 are urged toward their closed positions by coil compression springs acting against keeper retainer assemblies, as is well known in this art.

An exhaust camshaft 52 having cam lobes 63 is rotatably journaled in the cylinder head 42 by means including bearing cap 64. The cam lobes 63 cooperates with thimble tappets 65 for opening the exhaust valve 61.

The intake and exhaust camshafts 54 and 62 are driven in timed relationship from the crankshaft 38 at one half crankshaft speed. To accomplish this, there is provided a timing gear or sprocket 65 which is affixed to the upper end of the crankshaft 38 below the flywheel, magneto generator 60 and which is covered by the intake device and cover 49. This sprocket or drive gear 65 drives a timing belt 66 which, in turn, is enmeshed with sprockets 67 and 68 that are affixed to the upper ends of the intake and exhaust camshafts 54 and 62, respectively.

The camshafts 54 and 62 and valve actuating mechanism is contained within a cam cover assembly 69 that is affixed to the cylinder head 42 in a known manner. An idler gear or sprocket 71 (FIG. 3) is mounted on the upper end of the cylinder block 32 and is adjustable so as to maintain the desired tension in the timing belts 66.

Continuing now to describe the exhaust system, the cylinder head exhaust passages 59 curve and enter into an exhaust manifold 72 that is formed integrally in one side of the cylinder block 32. This exhaust manifold 72 delivers the exhaust gasses in a downward direction to the driveshaft housing 18 and lower unit 19 for silencing and discharge to the atmosphere through, for example, an underwater exhaust gas discharge and an above the water low speed exhaust gas discharge.

The fuel supply system will now be described continuing to refer to FIGS. 1 through 5. As has been noted, the fuel filter 31 receives fuel from the remote fuel tank 28 through the conduit 29. As may be best seen in FIGS. 2 through 4, the fuel filter 31 is mounted on the lower portion of the intake side of the cylinder head 42. The fuel filter 39 in turn delivers the filtered fuel through a fuel supply line 73 to a pair of mechanical fuel pumps 74 and 75. These fuel pumps 74 and 75 are mounted on the cylinder head 42 in a nested relationship to the manifold runners that serve the cylinder head intake passages 52.

Each fuel pump 74 and 75 is comprised of a body portion 76 that is appropriately affixed to the cylinder head and which contains a pumping device of any known type. For example, the pumping devices may be piston type pumps, diaphragms or any other known type of reciprocating or rotary pump. These pumping elements are operated by pumping plungers 77 that extend through the housing 76 and are journaled in bores 78 formed in the cylinder head 14 in the area adjacent the intake camshaft 54.

In this embodiment, there are two fuel pumps 74 and 75, and they are each mounted adjacent a respective cam lobe 56 of the intake camshaft 54 that operates a valve 53 of a specific cylinder. If the engine 14 is provided with one intake and one exhaust valve per cylinder, the plunger 77 are associated with the intake valves of cylinder numbers 2 and 3 in this embodiment. This is numbering the cylinders in order from top to bottom.

Figure 4:
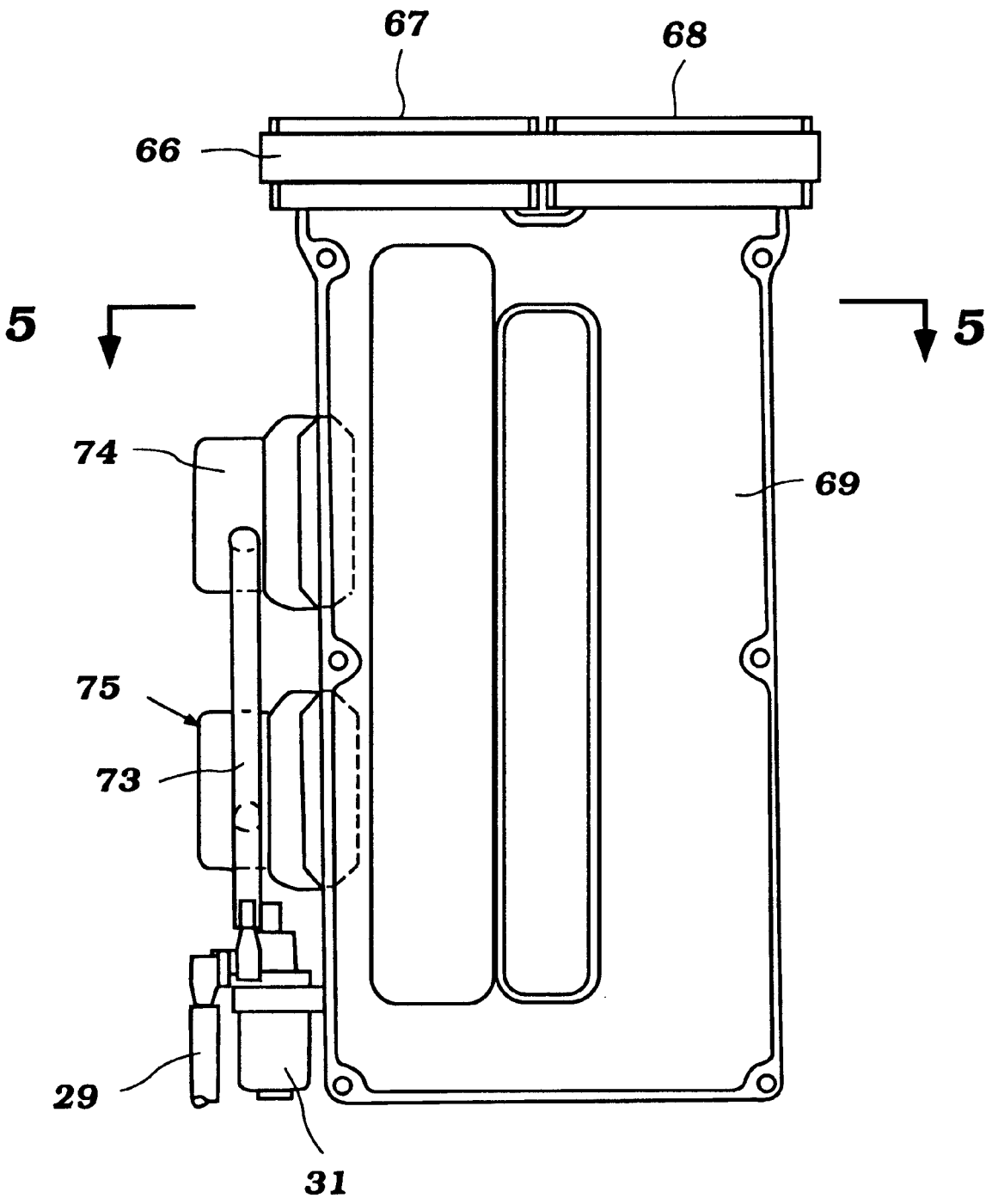
FIG. 4 is a view looking generally in the direction of the arrow 4 in FIG. 3.

Thus, no additional driving mechanism is required for the pump 74 and 75 and they are driven by the same cam lobes that operate the valves. Also, the fuel pumps 74 and 75 may actually be located at any desired relationship along the cylinder head 42 and specifically in proximity to the center of the engine. As seen in FIGS. 2 and 4, this permits the fuel pumps 74 and 75 to be actually located quite close to the carburetors 48.

Thus, a pair of conduits 79 extend from each fuel pump 74 and 75 to a feed line 81 which, in turn, serves the float bowls of the respective carburetors 48. It should be seen that this physical relationship is such that the carburetors 48 are all spaced relatively closely to their source of fuel supply.

Figure 6:
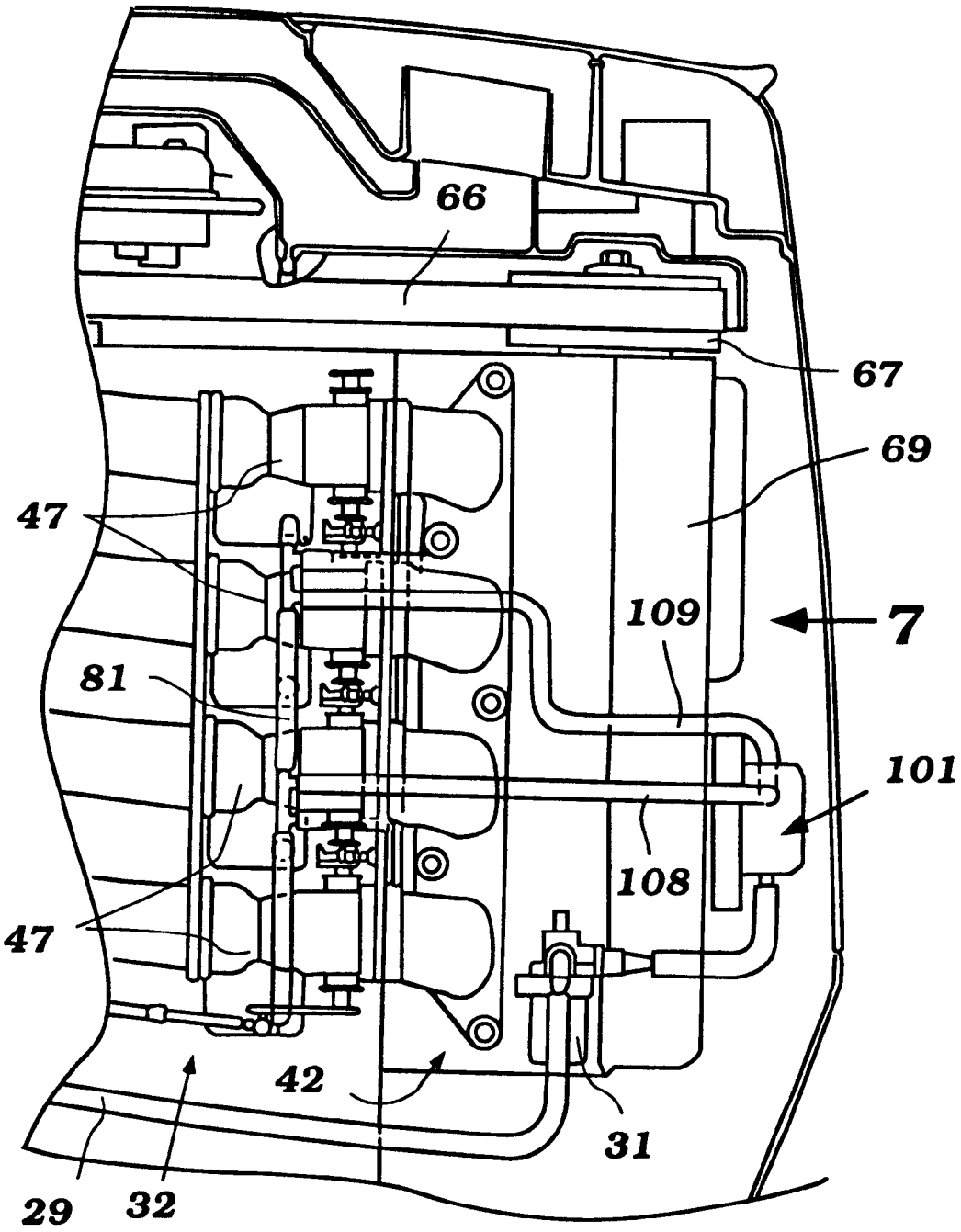
FIG. 6 is a partial side elevational view, in party similar to FIG. 2 and shows another embodiment of the invention.
Figure 7:
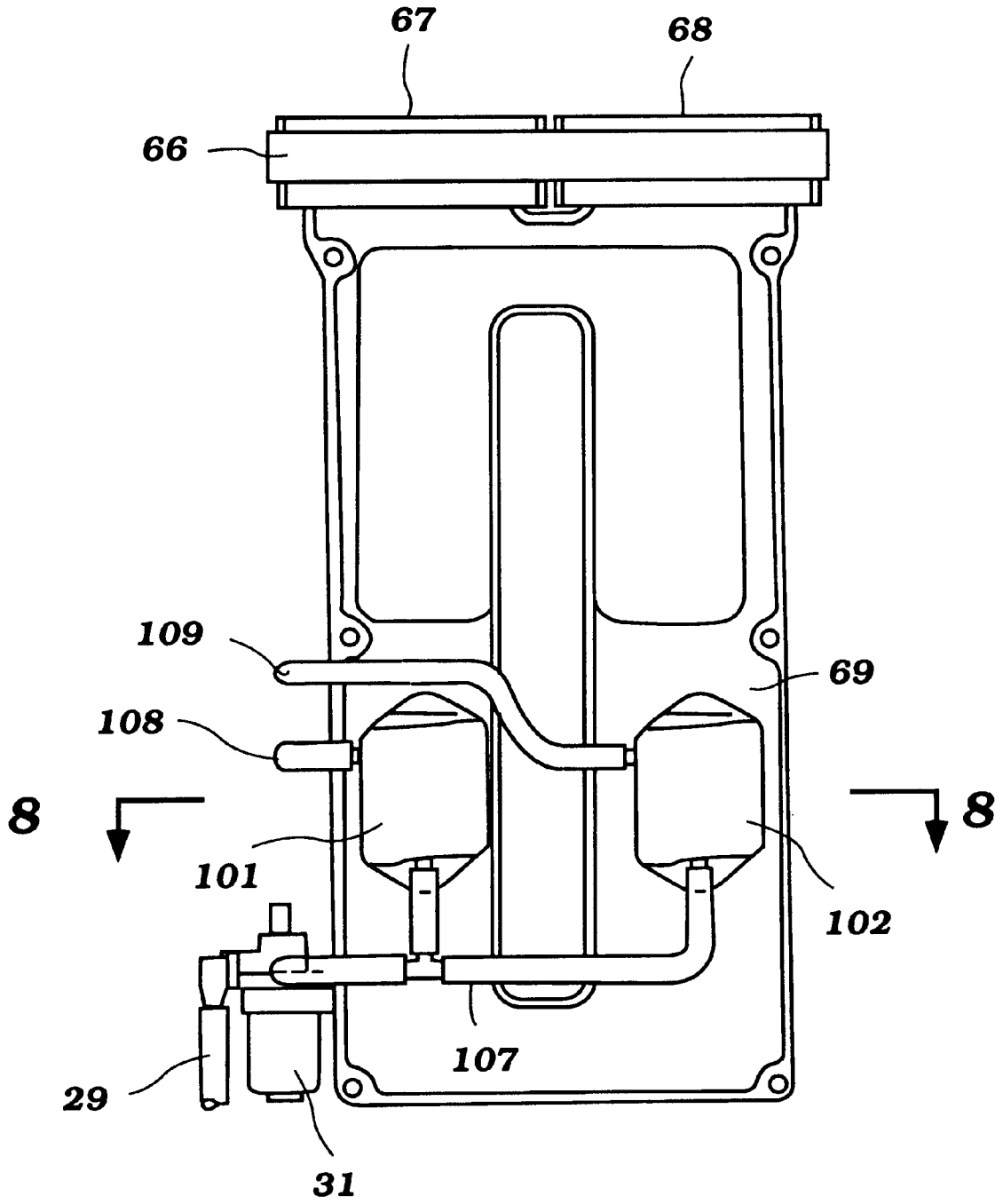
FIG. 7 is a view looking generally in the direction of the arrow 7 in FIG. 6 and shows the cam cover arrangement and association with the fuel pumps for this embodiment.
Figure 8:
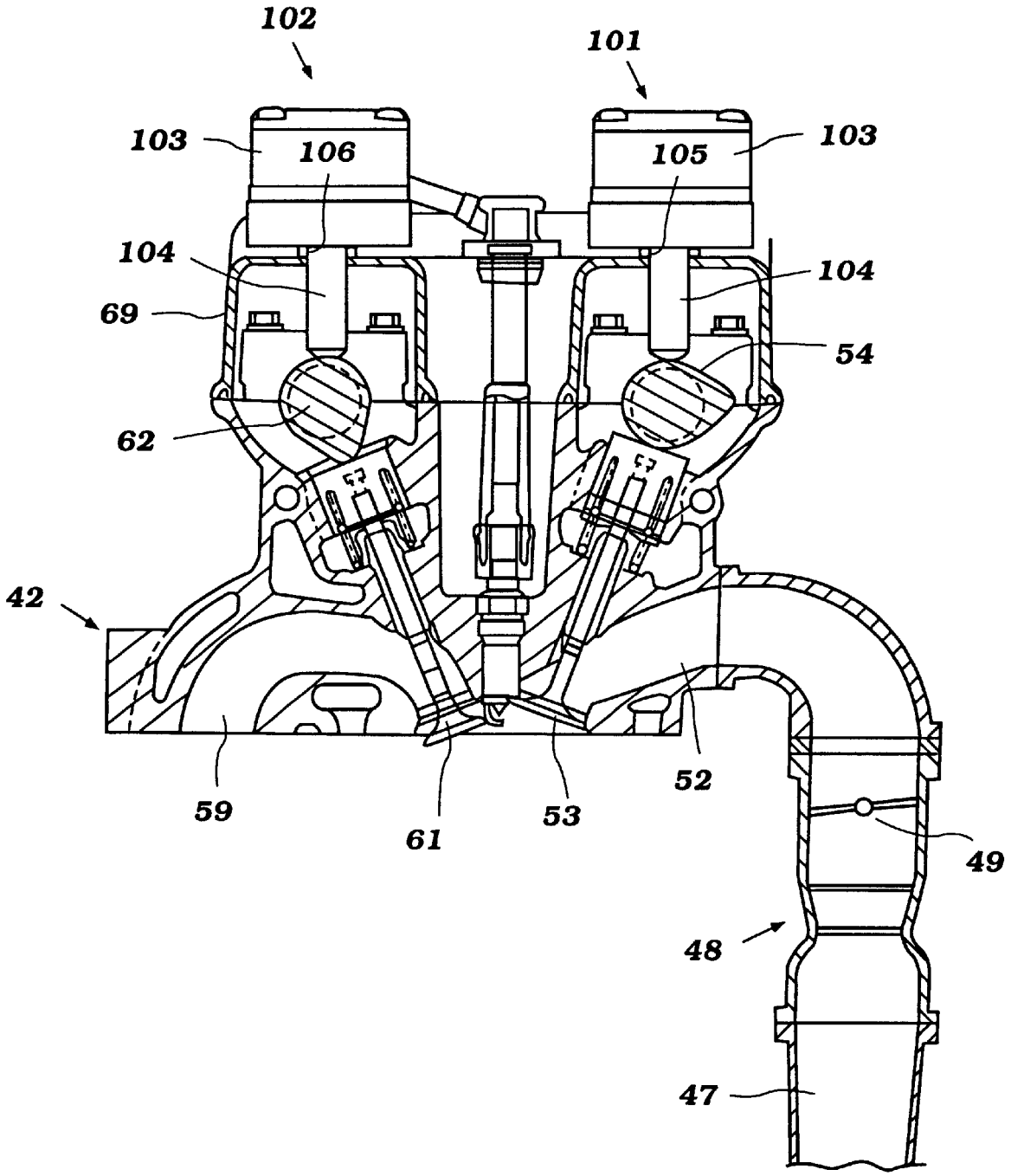
FIG. 8 is a cross-sectional view taken along the line 8—8 of FIG. 7 but shows only the cylinder head construction of this embodiment.

In the embodiment as thus far described, the fuel pump 74 and 75 are mounted on the side of the cylinder head. However, other locations are possible and FIGS. 6 through 8 show another embodiment which is basically the same as that embodiment already described. For that reason, components of this embodiment which are the same as the previously described embodiment have been identified by the same reference numerals and will not be described again, except insofar as is necessary to understand the construction and operation of this embodiment. In fact, the basic structure of the engine 14 is the same and the only difference is the location of the fuel pumps indicated by the reference numerals 101 and 102 in this embodiment.

Like the previously described embodiment, the fuel pumps 101 and 102 may be of any construction and preferably are of the positive displacement type. These fuel pumps 101 and 102 are mounted, in this embodiment, on the top of the cam cover 69. Each pump has a body portion 103 that slidably supports an actuating pump plunger 104. The pump plungers 104 are supported in bores 105 and 106 formed in the upper surface of the cam cover 69 and in alignment with lobes of the intake camshaft 54 and the exhaust camshaft 62, respectively.

Thus, like the previously described embodiment, no additional driving connection is required other than the mere provision of the plungers 104 and their cooperation with respective cam lobes. Also like the previously described embodiments, this embodiment permits the fuel pumps 101 and 102 to be positioned at any convenient location along the length of the engine.

Like the previously described embodiment, fuel is supplied to the fuel pumps 101 and 102 from the fuel filter 31 which is again mounted at the lower end of the cylinder head assembly 42. A fuel line 107 supplies fuel from the fuel filter 31 to each of the fuel pumps 101 and 102. Outlet conduits 108 and 109 again extend from the fuel pumps 101 and 102 to the manifold line 81 that serves the carburetors 48.

Figure 9:
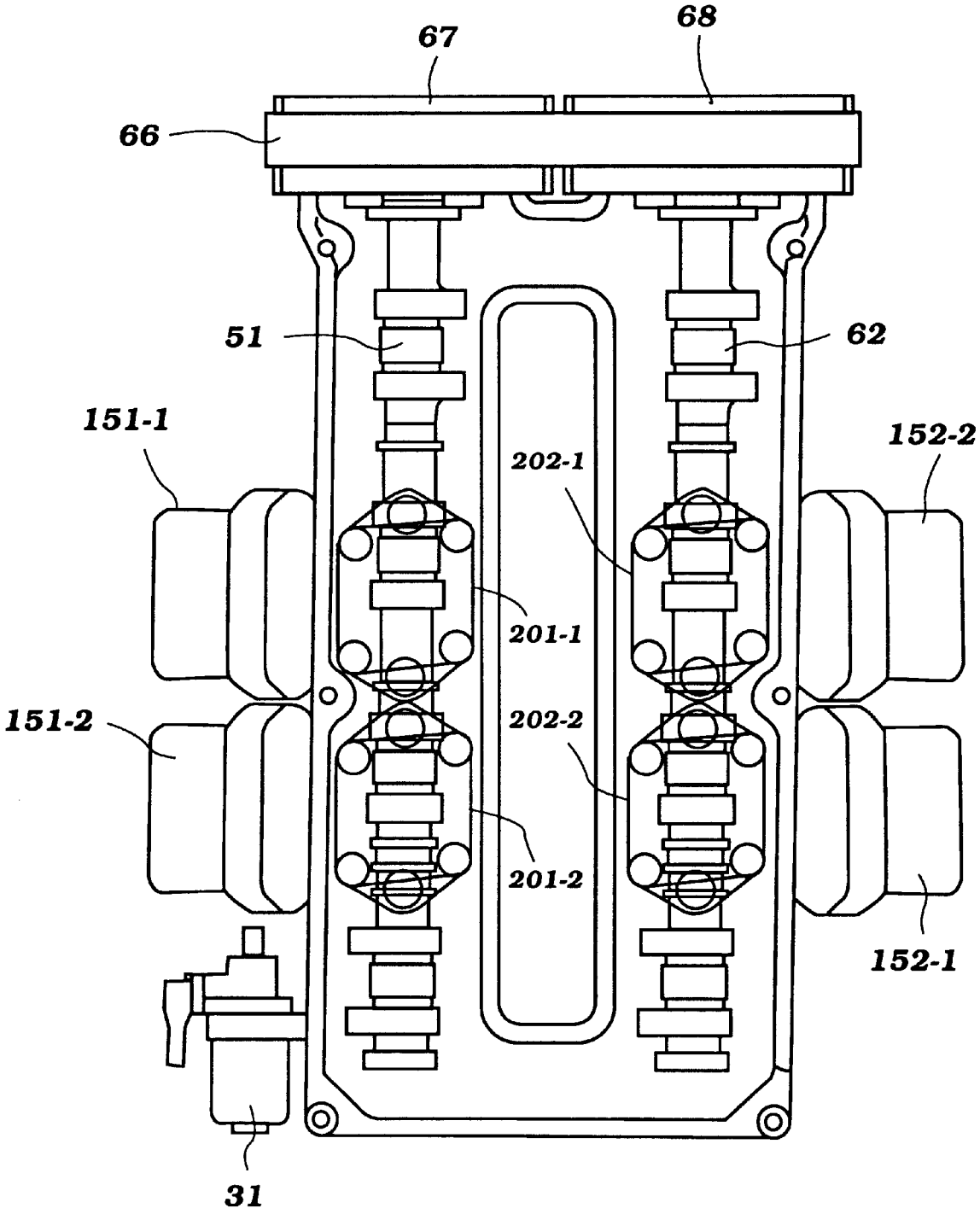
FIG. 9 is a view in part similar to FIG. 7 but with the cam covers removed and shows another embodiment of the invention.

In the embodiments thus far described, the engine has been provided with two fuel pumps, one for each pair of cylinders of the engine. However, the invention also may be practiced by utilizing more than two fuel pumps. For example, FIG. 9 shows two different embodiments, one in which four fuel pumps are employed mounted in relationship as shown in FIGS. 1 through 5 but having a pair of fuel pumps 151-1 and 151-2 associated on the intake side of the engine and a pair of fuel pumps 152-1 and 152-2 associated with the exhaust camshaft. The fuel pumps 151-1 and 151-2 and the fuel pumps 152-1 and 152-2 are driven off the camshafts at the respective sides of the cylinder head 42.

Alternatively, the mounting arrangement as shown in FIGS. 6 through 8 can be employed. As shown in this figure there are then provided the fuel pumps 201-1 and 201-2 that are associated with the intake camshaft 54 and mounted on the top of the cam cover. In a like manner, a pair of fuel pumps 202-1 and 202-2 are mounted on the other side of the cam cover and cooperate with the exhaust camshaft 62 and are driven by its lobes.

Furthermore, any other combination of these arrangements may be employed. That is, there can be one side mounted and one top mounted fuel pump associated with either or both of the camshafts 51 and 72.

Thus, from the foregoing description, it should be readily apparent that the described embodiments of the invention provide a very effective and compact fuel pump drive arrangement for an internal combustion engine. The fuel pumps are driven without requiring any separate couplings to the camshafts and can be driven by the same lobes that operate valves of the engine.

Of course, the foregoing description is that of a preferred embodiments of the invention. Various changes and modifications may be made without departing from the spirit and scope of the invention, as defined by the appended claims.

What is claimed is:

1. An internal combustion engine comprised of a cylinder block, cylinder head assembly defining a plurality of cylinder bores in each of which a respective piston reciprocates to form a plurality of combustion chambers, a crankshaft rotatably journaled by said cylinder block, cylinder head assembly and driven by said pistons, at least one intake passage for delivering an intake charge to each of said combustion chambers, at least one exhaust passage for discharging a burnt charge from each of said combustion chambers, a camshaft rotatably journaled within a cam chamber closed by a cam cover affixed to the cylinder head of said cylinder block, cylinder head assembly about an axis parallel to the axis of said crankshaft and driven by said crankshaft in timed relationship thereto, said camshaft having at least one lobe thereon for operating a valve for valving the flow through at least one of said intake and exhaust passages, a fuel pump mounted on said engine and having an actuating plunger directly engaged by said cam lobe for driving said fuel pump, and at least two charge formers supplied with fuel by said fuel pump.

2. An internal combustion engine as set forth in claim 1, wherein the fuel pump is located between the ends of said camshaft.

3. An internal combustion engine as set forth in claim 2, wherein the fuel pump is located at approximately the same distance form each charge former to which it supplies fuel.

4. An internal combustion engine as set forth in claim 1, wherein the fuel pump is mounted directly on the cylinder head adjacent the cam cover.

5. An internal combustion engine as set forth in claim 1, wherein the engine is provided with a manifold serving a plurality of valves operated by the camshaft and the fuel pump is nested between the cylinder head and said manifold.

6. An internal combustion engine as set forth in claim 5, wherein the fuel pump is located between the ends of said camshaft.

7. An internal combustion engine as set forth in claim 6, wherein the fuel pump is located at approximately the same distance form each charge former to which it supplies fuel.

8. An internal combustion engine as set forth in claim 1, wherein the fuel pump is mounted directly on the cam cover.

9. An internal combustion engine as set forth in claim 8, wherein the fuel pump is located between the ends of said cam cover.

10. An internal combustion engine as set forth in claim 9, wherein the fuel pump is located at approximately the same distance form each charge former to which it supplies fuel.

11. An internal combustion engine as set forth in claim 1, wherein the cam shaft has a plurality of cam lobes each operating a respective valve and there are at least two fuel pumps each driven by a respective one of the lobes.

12. An internal combo engine as set forth in claim 11, wherein the fuel pumps are located between the ends of said camshaft.

13. An internal combustion engine as set forth in claim 12, wherein each of the fuel pumps is located at approximately the same distance form each charge former to which it supplies fuel.

14. An internal combustion engine as set forth in claim 13, wherein the cam shaft is mounted within a cam chamber closed by a cam cover affixed to the cylinder head.

15. An internal combustion engine as set forth in claim 14, wherein the fuel pumps are mounted directly on the cylinder head adjacent the cam cover.

16. An internal combustion engine as set forth in claim 15, wherein the engine is provided with a manifold serving the valves operated by the camshaft and the fuel pumps are nested between the cylinder head and said manifold.

17. An internal combustion engine as set forth in claim 13, wherein the fuel pumps are mounted directly on the cam cover.

18. An internal combustion engine as set forth in claim 1, wherein the engine has a pair of cam shafts each having a respective cam lobe for actuating a respective valve and there are at least two fuel pumps each operated by a respective cam shaft.

* * * * *